United States Patent [19]

John

[11] 4,158,963

[45] Jun. 26, 1979

[54] PROCESS FOR DETERMINING THE LOCATION AND/OR EXTENT OF ROCK CAVITIES

[75] Inventor: Peter W. John, Bad Oldesloe, Fed. Rep. of Germany

[73] Assignee: Preussag Aktiengesellschaft, Fed. Rep. of Germany

[21] Appl. No.: 868,502

[22] Filed: Jan. 11, 1978

[30] Foreign Application Priority Data

Jan. 22, 1977 [DE] Fed. Rep. of Germany ..... 2702622

[51] Int. Cl.[2] ..... E21B 47/00

[52] U.S. Cl. ..... 73/151; 181/106

[58] Field of Search ..... 73/88 E, 155, 151; 181/102, 105, 106; 166/250, 251, 254

[56] References Cited

U.S. PATENT DOCUMENTS

| | | | |
|---|---|---|---|
| 2,151,878 | 3/1939 | Weatherby | 181/106 |
| 4,057,780 | 11/1977 | Shuck | 181/106 X |

*Primary Examiner*—Jerry W. Myracle

*Attorney, Agent, or Firm*—Allegretti, Newitt, Witcoff & McAndrews

[57] ABSTRACT

The size and location of rock formation cavities are determined by placing small bodies within the cavity, altering the physical or chemical state of the bodies within the cavity and measuring the change of state of the bodies thereby providing a measurement of the location or size of the cavity. Preferably, the small bodies are detonatable bodies which upon detonation provide an acoustic indication of the size and location of the cavity.

10 Claims, 4 Drawing Figures

PROCESS FOR DETERMINING THE LOCATION AND/OR EXTENT OF ROCK CAVITIES

BACKGROUND OF THE INVENTION

The invention relates to a process for determining the location and/or the size of rock cavities, particularly artificially generated rock cracks.

A process for determining the location or the extent or rock cavities or formations which is based on electrical resistance measurement is known. To exactly determine the presence of small cavities by this method, it is necessary to perform several drillings and to introduce resistance measuring probes. If the cavities or rock cracks are artificially generated, this prior art process largely fails, particularly because the resistance changes evoked by the artificial cracks cannot be exactly interpreted. This prior art method of measurement suffers also from the fact that it is dependent, not so much on the actual cavity or the inclusion of various material in the cavity, but more importantly on the moisture content of the rock.

It is also theoretically possible to utilize acoustic measuring processes to determine the location and the course of cracks. Thermal tensions and pressure variations in the vicinity of a crack, particularly in coal and country rock (Nebengestein) generate acoustic signals which can be measured. These signals, however, are not locally bounded and are indefinite, both with respect to their nature and their duration, so that an exact interpretation of the signals picked up by the geophones is not possible.

In the particular case of the artificial production of rock cracks, mostly designated as Frac technology, it is essential that the size, position and course of the cracks be determined. All of the known measuring processes for the determination of artificial cracks have the common disadvantage that, because of limited penetration depth and range, a satisfactory registration and adequate resolution and interpretation of the measurement signals is impossible.

The determination of the exact position and extent of rock cracks is of extreme importance in processes for the recovery of gas from coal, wherein coal seams are opened up by drillings, between which opened seams, by reason of natural permeability in the formation, there is present a permeable connection through naturally occurring of artificial gaps or crack fission systems. Into one of the bores of the drill, particularly an injection bore, gases or vapors having as the main components thereof air, water vapor, oxygen or mixtures of these, are introduced which penetrate into a seam and support an initial combustion process and a subsequent gasification process. The resulting gas mixture is then removed from the production bore.

As a rule, the natural permeability is not satisfactory. As a result, the permeability of the seam must be artifically reinforced or even established. For example, rock cracks can be generated hydraulically by the so-called "hydraulic fracturing" method. In this method the energy of the frac fluid is used to induce cracking in the formation and, simultaneously, through the transport capacity of the fluid a supporting agent is introduced into the newly created crack, to hold the crack open against the rock pressure.

Both the cavity formed from the artificially generated crack and the cavity arising from the combustion reaction are, with the conventional methods described, virtually incapable of having their position and extent determined. In particular, it is also impossible, in practice, to monitor the extent, the location and the progress of the combustion reaction.

Accordingly, underlying the present invention is the problem of providing a process for determining the location and/or the extent of rock cavities, especially of artificially generated rock cracks, which is exact, simple and dependable and which produces measurable results which are interpretable.

SUMMARY OF THE INVENTION

The problem underlying the present invention is solved by introducing and distributing into the cavity, small bodies, spaced from one another within the cavity, locally and progressively altering the physical and/or chemical state of the cavity in such a way that the bodies also change their physical and/or chemical state, and locating the bodies because of this physical and/or chemical change of state.

The invention is based, therefore, on the idea of introducing small bodies spatially distributed from each other into the natural or artificially formed cavities, i.e. cracks, in order to act upon the bodies by a spatial progressive change so that, the reactions of the bodies can be measured or determined.

This principle can be simply utilized through the use of detonatable bodies as the small bodies which are detonated by the progressive physical and/or chemical change of state of the cavity. The location of each detonation is then determined by seismic procedures known to the art. The progressive physical change of state may be effected by a progressive heating zone, for example a combustion zone, which progresses through a combustible substance introduced into the cavity or through a coal seam adjoining the cavity.

This method of performing the process of the present invention when the heating zone is moved causes the small bodies to detonate upon reaching a certain temperature. The position of the individual detonated bodies can be determined and then located through convetional seismic locating devices. In actual practice, it is safe to assume that the small detonating bodies are positioned in all essential spaces or expanded portions of the cavity. As a result, the entire extent and position of the cavity can be determined. Simultaneously, there is produced, of course, a special advantage in that the location and velocity of the combustion zone can be indirectly determined.

In another embodiment of this invention there is utilized a progressive change in the chemical state within the cavity. This change in chemical state proceeds from one side of the cavity, for example an edge of a crack, and thus affects the small bodies which, by reason of chemical reaction, are caused to detonate directly or to detonate with interposition of chemical-mechanical processes.

Another embodiment of the present invention consists of depositing small bodies of different physical or chemical nature in predetermined, preferably known, arrangement in the cavity. The small bodies are identified and located on the basis of the differences in physical or chemical nature. It is also appropriate to note that in the case of small bodies having a differing chemical nature, a fluid can be introduced from one side of the cavity, which dissolves or reacts with the small bodies. The fluid is subsequently removed from the cavity at a point remote from the point of introduction and the substance contained in the removed fluid, carried along by the solution or reaction of the small bodies is determined as a function of time. In this embodiment of the process, therefore, the small bodies consist of different substances. It is possible to proceed on the assumption that, for example, the solution of the small bodies that is brought about by the fluid introduced into the cavity progresses slowly therethrough. As a result, by examining the liquid flowing from the cavity and knowing the composition of the small bodies going into solution, and, on the basis of the previously determined geometric allocation of the bodies, it is possible to determine the position of the bodies.

The invention further relates to a small body for use in a process for determining the location and/or the extent of rock cavities. The bodies contain an explosive according to the invention. Preferably, the explosive is surrounded by a capsule. It is also possible for the body to have the form of small spheres or thin foil strips.

BRIEF DESCRIPTION OF THE DRAWINGS

The invention can be explained in detail by reference to the attached drawings.

DESCRIPTION OF THE PREFERRED EMBODIMENT

Figure 1:
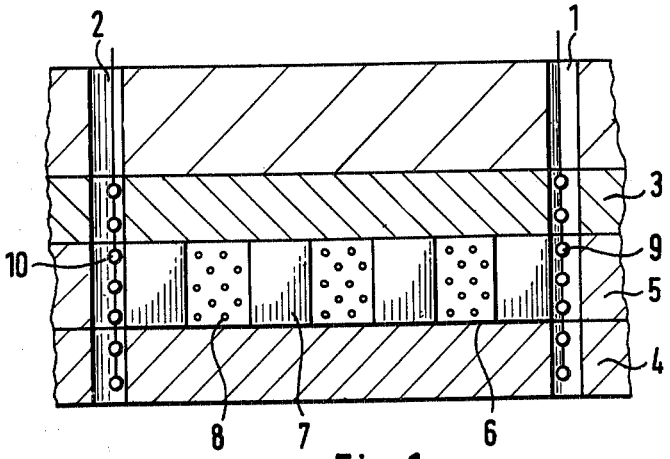
FIG. 1 illustrates schematically, a rock formation section along a crack to be investigated.

FIG. 1 illustrates a section through a rock formation, into which has been introduced an injection bore 1 and a production bore 2. A seam of coal 5 is positioned between a roof 3 and a floor 4. Upon introduction of a high pressure liquid into the bores 1 and 2, a crack 6 (schematically represented) is introduced into the coal extending between the injection bore 1 and the production bore 2.

According to the process of the invention, there are deposited in crack 6 between conventional supports 7 small detonatable bodies 8. The deposition takes place in a manner known to the art.

After completion of the deposition step, there are introduced into the injection bore 1 and the production bore 2 geophones 9 and 10, which are connected in a conventional manner to corresponding measuring arrangements.

Figure 2:
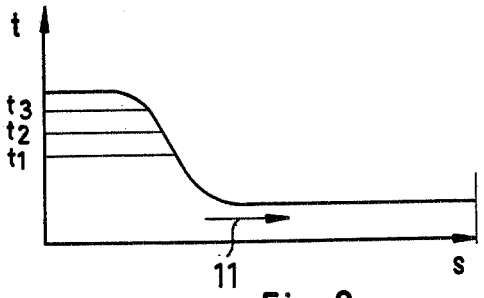
FIG. 2 graphically illustrates the temperature of a progressive combustion zone.

In accordance with the process of the invention, the coal seam 5 is ignited in the zone proximate to the production bore 2. A gaseous mixture comprising air, hydrogen, oxygen or mixtures thereof is introduced into injection bore 1 to provide a sustaining combustion and gasification process. The combustion zone moves from the production bore 2 counter current to the flow of gases entering injection bore 1. The reaction temperature is plotted in FIG. 2 as a function of the distance along path s between the injection bore 1 and the production bore 2. The zone moves from bore 2 towards bore 1 in the direction of an arrow 11. Also indicated on FIG. 2 are defined temperatures $t_1$, $t_2$, $t_3$ . . . For example, $t_2$ may be the temperature at which the small bodies detonate. The point where the temperature line $t_2$ intersects the temperature curve, defines the location or distance along path s at which the detonation takes place. The geophones 9 and 10 then detect and measure the detonation by conventional measuring techniques.

The supports 7 and the small bodies 8 form, in each case, a series of defined zones. The zone in which the small detonatable bodies are located can, according to another embodiment of this invention, be filled with large amounts of deposited explosive in order to increase the detonation energy. In such a case, the small detonatable bodies act as igniters.

Figure 3:
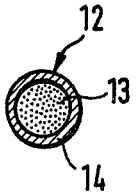
FIG. 3 is a section view of a small, spherical, detonatable body.

FIG. 3 shows a small body 12 whose explosive 13 is surrounded by a capsule 14.

Figure 4:
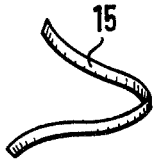
FIG. 4 illustrates a small body in the form of a foil.

FIG. 4 shows a small body in the form of a foil strip 15 of explosive. Under certain conditions, this body is easier to embed within crack 6.

I claim as my invention:

1. A process for determining the location or size of a rock formation cavity including artificially generated rock formation cracks which comprises introducing small bodies spaced from one another into the cavity, progressively altering the state of the small bodies within the cavity, and measuring the change of state of the small bodies thereby providing a measurement of the location or size of the cavity.

2. A process according to claim 1 characterized in that the small bodies are introduced into the cavity by means of a carrier fluid.

3. A process according to claim 1 characterized in that the small bodies are introduced and deposited into the cavity with a supporting means.

4. A process according to claim 1 characterized in that the small bodies comprise detonatable bodies, said process including successively detonating by progressive change of state of the small bodies within the cavity.

5. A process according to claim 4 characterized in that a chemical fluid is introduced into the cavity which, on reaching the small bodies, produces a detonation.

6. A process according to claim 1 characterized in that small bodies having different nature are deposited in a predetermined position in the cavity whereby the differences in the nature of the small bodies permit the cavity to be located.

7. A process according to claim 1 characterized in that small bodies are embedded in the cavity as igniters of explosives also introduced into the cavity.

8. A process for determining the location or size of a rock formation cavity including artificially generated rock formation cracks which comprises introducing small bodies spaced from one another into the cavity, progressively altering the state of the small bodies within the cavity by heating them, and measuring the change of state of the small bodies thereby providing a measurement of the location or size of the cavity.

9. A process according to claim 8 characterized in that the progressive heating is provided by progressive combustion of combustibles introduced into the cavity or of the combustible parts of the rock formation adjacent to the cavity.

10. A process for determining the location or size of a rock formation cavity including artificially generated rock formation cracks which comprises introducing small bodies spaced from one another in predetermined positions in the cavity, which small bodies have a differing chemical nature across the cavity, introducing a fluid into the cavity to dissolve or react with the small bodies, removing the fluid from the cavity at a point remote from the point of introduction, and measuring the amount of small bodies in the removed fluid as a function of time, thereby providing a measurement of the location or size of the cavity.

* * * * *